US007905966B2

(12) United States Patent
Waeckerle et al.

(10) Patent No.: US 7,905,966 B2
(45) Date of Patent: Mar. 15, 2011

(54) METHOD OF PRODUCING A STRIP OF NANOCRYSTALLINE MATERIAL AND DEVICE FOR PRODUCING A WOUND CORE FROM SAID STRIP

(75) Inventors: Thierry Waeckerle, Nevers (FR); Thierry Save, Coulanges les Nevers (FR); Alain Demier, Varennes Vauzelles (FR)

(73) Assignee: Imphy Alloys, Saint Denis (FR)

( * ) Notice: Subject to any disclaimer, the term of this patent is extended or adjusted under 35 U.S.C. 154(b) by 389 days.

(21) Appl. No.: 11/914,787

(22) PCT Filed: May 19, 2006

(86) PCT No.: PCT/FR2006/001170

§ 371 (c)(1),
(2), (4) Date: Jan. 30, 2008

(87) PCT Pub. No.: WO2006/123072

PCT Pub. Date: Nov. 23, 2006

(65) Prior Publication Data

US 2008/0196795 A1 Aug. 21, 2008

(30) Foreign Application Priority Data

May 20, 2005 (EP) ..... 05291098

(51) Int. Cl.

| | |
|---|---|
| ***C21D 1/84*** | (2006.01) |
| ***C22C 38/00*** | (2006.01) |
| ***C22C 38/16*** | (2006.01) |
| ***C22C 38/02*** | (2006.01) |
| ***C22C 38/12*** | (2006.01) |

(52) U.S. Cl. ..... 148/540; 148/332; 148/337; 420/89; 420/117; 420/127

(58) Field of Classification Search ..... 148/540, 148/403, 332, 337; 266/249; 324/76.11; 336/233; 420/89, 117, 127

See application file for complete search history.

(56) References Cited

U.S. PATENT DOCUMENTS

| | | | |
|---|---|---|---|
| 2,642,764 | A | 6/1953 | Porth |
| 5,969,930 | A | 10/1999 | Bonniau et al. |
| 6,563,411 | B1 | 5/2003 | Otte et al. |

FOREIGN PATENT DOCUMENTS

| | | |
|---|---|---|
| EP | 0 271 657 | 6/1988 |
| EP | 0 687 134 | 12/1995 |
| FR | 2 823 507 | 10/2002 |
| JP | 1 235213 | 9/1989 |
| WO | 03 088281 | 10/2003 |

OTHER PUBLICATIONS

Alves et al., English machine translation of FR 2823507 A1, Oct. 2002.*

* cited by examiner

*Primary Examiner* — Roy King
*Assistant Examiner* — Caitlin Fogarty
(74) *Attorney, Agent, or Firm* — Oblon, Spivak, McClelland, Maier & Neustadt, L.L.P.

(57) ABSTRACT

The invention relates to a method of producing a strip of nanocrystalline material which is obtained from a wound ribbon that is cast in an amorphous state, having atomic composition $[Fe_{1-a-b}Co_aNi_b]_{100-x-y-z-\alpha-\beta-\gamma}Cu_xSi_yB_zNb_\alpha M'_\beta M''_\gamma$, M' being at least one of elements V, Cr, Al and Zn, and M" being at least one of elements C, Ge, P, Ga, Sb, In and Be, with: $a \leqq 0.07$ and $b \leqq 0.1$, $0.5 \leqq x \leqq 1.5$ and $2 \leqq \alpha \leqq 5$, $10 \leqq y \leqq 16.9$ and $5 \leqq z \leqq 8$, $\beta \leqq 2$ and $\gamma \leqq 2$. According to the invention, the amorphous ribbon is subjected to crystallization annealing, in which the ribbon undergoes annealing in the unwound state, passing through at least two S-shaped blocks under voltage along an essentially longitudinal axial direction of the ribbon, such that the ribbon is maintained at an annealing temperature of between 530° C. and 700° C. for between 5 and 120 seconds and under axial tensile stress of between 2 and 1000 MPa. The tensile stress applied to the amorphous ribbon, the displacement speed of the ribbon during annealing and the annealing time and temperature are all selected such that the cross-section profile of the strip is not in the form of a Ω and the maximum deflection of the cross-section of the strip is less than 3% of the width of the strip and preferably less than 1% of the width. The invention also relates to the strip and the core thus obtained and to the device used to implement said method.

12 Claims, 1 Drawing Sheet

Figure 1:
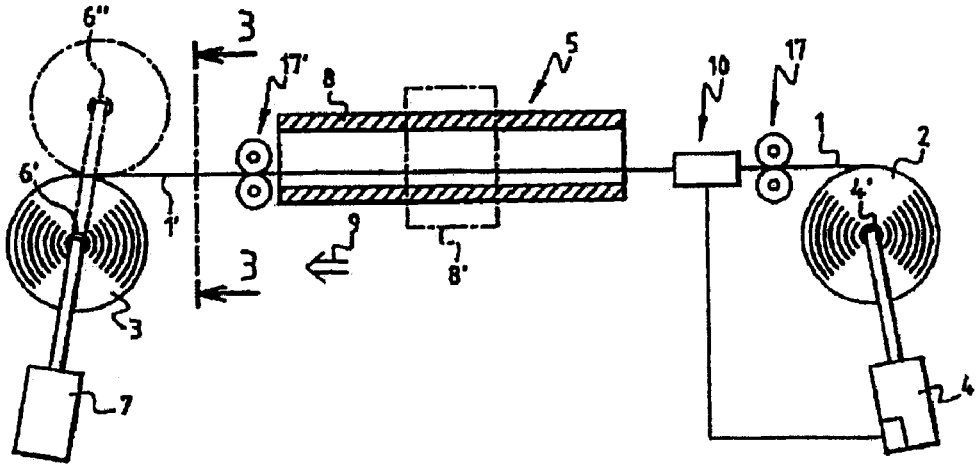
FIG. 1 PRIOR ART

METHOD OF PRODUCING A STRIP OF NANOCRYSTALLINE MATERIAL AND DEVICE FOR PRODUCING A WOUND CORE FROM SAID STRIP

The present invention relates to a process for the manufacture of a strip made of nanocrystalline material, to a device for the manufacture of a wound core starting from this strip and to the cores in question and the components which incorporate them.

The manufacture of cores made of nanocrystalline material of low permeability ($\mu \leqq 1000$) from amorphous ribbons of FeCuNbSiB type which are converted by an annealing is disclosed in particular in patent FR 2 823 507.

This document describes in particular a process for the stress annealing of these amorphous ribbons which significantly reduces the extreme brittleness of the nanocrystalline materials, which could not previously be handled after nanocrystallization in core form. This stress annealing process makes it possible to obtain mechanical properties such that it is possible to carry out the winding of the strip without risk of breaking and that it is also possible to unwind it and rewind it while still retaining the same winding spindles.

These improved mechanical properties are due to the production of an Ω-shaped nanocrystallized strip cross section, exhibiting at least points of inflection, with a deflection of greater than 1% of the width. This conformation corresponds to a less brittle state than a conventional nanocrystalline material, making it possible in particular to unwind and then rewind the crystallized ribbon on the same spindle; however, this state, with a marked Ω profile, still remains too brittle to be handled and unwound/rewound on spindles with a smaller diameter and in particular down to obtaining cores with a diameter of less than or equal to 10 mm.

Furthermore, due to the Ω profile, the magnetic performance and the percentage of breakage in rewinding are not independent of the face of the strip which is turned toward the outside of the core. When the boss of the Ω is directed toward the outside of the core, the performance is better and the level of breakage in rewinding is low; conversely for the Ω boss directed toward the inside of the core. Thus, in production, it is either necessary to allow the ribbon to be systematically with the boss of the Ω on the outside of the cores produced, which requires additional control and a more complex process to be employed, or the production output will be damaged and the performance will be mixed.

In addition, during automatic winding to give a core, the ribbon head can be very difficult to suck up and stick onto the winding spindle since the Ω profile prevents the ribbon head from being satisfactorily sucked up and stuck on by this partial vacuum phenomenon.

Furthermore, it is found that the more the permeability of the strip increases, the more brittle it is in its final state and the greater its level of breakage becomes. This process thus does not make it possible to produce a nanocrystalline strip industrially, in particular when its permeability exceeds 1000.

Finally, the reduced but still high brittleness of the strip obtained according to the prior art makes it possible to achieve a rate of forward progression which does not exceed 3 cm/s.

In point of fact, a nanocrystallization annealing process is considered to be an industrial process if it makes it possible to achieve a level of breakage of the amorphous ribbon of less than 10 breakages per km, with a rate of forward progression of greater than or equal to 10 cm per second and per meter of furnace working zone (zone having a temperature of greater than or equal to 500° C.), and a range for adjusting the annealing temperature of greater than 10° C. (range within which it is possible to vary the annealing temperature without significantly changing the performance of the strip, in particular its brittleness).

The aim of the present invention is thus to provide a process for the manufacture of nanocrystalline strips which is capable of being employed on an industrial scale, and also a nanocrystalline product which can be handled and used for magnetic circuit geometries which are more compact than those of the prior art, with in particular a much smaller winding radius than that known to date.

To this end, a first subject matter of the invention is a process for the manufacture of a strip made of nanocrystalline material which is obtained from a ribbon cast in an amorphous state, with the atomic composition:

$$[Fe_{1-a-b}Co_aNi_b]_{100-x-y-z-\alpha-\beta-\gamma}Cu_xSi_yB_zNb_\alpha M'_\beta M''_\gamma$$

M' being at least one of the elements V, Cr, Al and Zn, M'' being at least one of the elements C, Ge, P, Ga, Sb, In and Be, with:

$$a \leqq 0.07 \text{ and } b \leqq 0.1$$

$$0.5 \leqq x \leqq 1.5 \text{ and } 2 \leqq \alpha \leqq 5$$

$$10 \leqq y \leqq 16.9 \text{ and } 5 \leqq z \leqq 8$$

$$\beta \leqq 2 \text{ and } \gamma \leqq 2$$

by subjecting the amorphous ribbon to a crystallization annealing in which the ribbon is subjected to the annealing in the unwound state, in forward progression through at least two S-type units and under tension in a substantially longitudinal axial direction of the ribbon, so that the ribbon is maintained at an annealing temperature of between 530° C. and 700° C., for a period of time of between 5 and 120 seconds, under an axial tensile stress of between 2 and 1000 MPa, the tensile stress to which said amorphous ribbon is subjected, its rate of forward progression during said annealing, the annealing time and the annealing temperature being chosen so that the cross section profile of the strip is not Ω-shaped and exhibits a maximum deflection of the transverse cross section of the strip of less than 3% of the width of the strip and preferably of less than 1% of the width.

The present inventors have observed, entirely surprisingly, that it is possible to considerably reduce the brittleness of the nanocrystalline strips by conferring thereon a planar cross section which does not exhibit an Ω profile. This reduction in brittleness makes it possible to considerably reduce the level of breakage per km and to increase the rate of forward progression of the strip.

Without wishing to be committed to a theory, the present inventors have in fact discovered that, at a given rate of forward progression and a given tensile stress, the more the stress annealing temperature or time increases, the more the crystallized fraction $f_x$ increases until a critical crystallized fraction $f_x^c$ is reached, which fraction depends on the level of stress. If $f_x$ becomes greater than this critical fraction $f_x^c$, then the Ω profile begins to appear and the material becomes markedly more brittle.

It is possible, by this novel process involving appropriate adjusting of the annealing conditions (tensile stress, rate of forward progression, annealing time and annealing temperature), to stabilize production at a crystallized fraction lower than the critical recrystallized fraction, so as to avoid an Ω strip cross section profile. A strip is thus obtained which is capable of being easily taken up at the beginning of winding, of being coiled up onto large diameter supports without outof-rounds, and of being efficiently and without distinction wound with either of its faces turned toward the outside of the core.

The process according to the invention can additionally exhibit the following characteristics, taken alone or in combination:

- the rate of forward progression of the strip is greater than or equal to 10 cm per second and per meter of furnace working zone,
- the axial tensile stress is greater than 500 MPa,
- the level of breakage of the amorphous ribbon in forward progression is less than 10 breakages per kilometer of ribbon,
- y is greater than or equal to 12.

In a preferred embodiment, the composition of the amorphous ribbon is chosen so that:

$$a \leqq 0.04 \text{ and } b \leqq 0.07$$

$$0.5 \leqq x \leqq 1.5 \text{ and } 2 \leqq \alpha \leqq 5$$

$$13 \leqq y \leqq 16.6 \text{ and } 5.8 \leqq z \leqq 8$$

$$\beta \leqq 2 \text{ and } \gamma \leqq 2$$

In another preferred embodiment, the composition of the amorphous ribbon is chosen so that:

$$a \leqq 0.02 \text{ and } b \leqq 0.05$$

$$0.5 \leqq x \leqq 1.5 \text{ and } 2.5 \leqq \alpha \leqq 4$$

$$14.5 \leqq y \leqq 16.5 \text{ and } 5.8 \leqq z \leqq 7.5$$

$$\beta \leqq 1 \text{ and } \gamma \leqq 1$$

The latter two embodiments employing specific composition ranges are more particularly of use in the manufacture of current sensors capable of measuring a current comprising a strong continuous component which can be used in a single-stage or two-stage energy meter, comprising at least one core made of said nanocrystalline material, and also in the manufacture of storage or filtering inductors which are independent of the level of superimposed continuous component and which can be used in an energy meter, comprising at least one core made of said nanocrystalline material.

A second subject matter of the invention is a strip made of nanocrystalline material which can be obtained by the implementation of the process according to the invention, capable of being subjected, at any point on this strip, to bending with a diameter of curvature of at most 3 mm, without exhibiting breakage or cracking.

The strip according to the invention can additionally exhibit the following characteristics, taken alone or in combination:

- strip obtained by the implementation of the process according to the invention starting from an amorphous ribbon, the thickness of said strip being reduced by at least 10% with respect to the thickness of said amorphous ribbon,
- strip having a coercive field of less than or equal to 7 A/m and preferably of less than or equal to 5 A/m,
- strip having an induction at 200 Oe of greater than or equal to 12 kG.

A third subject matter of the invention is a core made of nanocrystalline material which can be obtained by the implementation of the process according to the invention, on conclusion of which said nanocrystalline strip is wound, the permeability of which is greater than or equal to 50 and less than 200 and the cutoff frequency of which is between 30 and 200 MHz, and a core having a diameter of less than or equal to 10 mm.

In a preferred embodiment, the core according to the invention exhibits a deterioration in the dilatation of at most 3% in comparison with the dilatation obtained by winding a strip of the same composition which has been subjected to a stress-free crystallization annealing, this being the case for a reduction in thickness of the nanocrystallized strip ranging up to 10% with respect to the thickness of the starting amorphous ribbon.

In another preferred embodiment, the core according to the invention is obtained by the process according to the invention, on conclusion of which said nanocrystalline strip is wound a first time on a first spindle and then, by unwinding and subsequent winding, is wound on a second spindle, the diameter of the second spindle being less than the diameter of the first spindle.

A fourth subject matter of the invention is a device (1) for the manufacture of a magnetic core from a ribbon (R) cast in an amorphous state by annealing said amorphous ribbon (R), which comprises:

- a shaft for receiving (2) a coil of ribbon (R) in the amorphous state,
- a temperature-regulated tunnel furnace (3),
- at least one S-type unit (4) situated before the inlet for the ribbon (R) into the furnace (3) and connected to a brake motor (5),
- a device (6) for adjusting a tensile stress in the axial direction of said amorphous ribbon (R) and of the strip (N) made of nanocrystalline material, said device (6) comprising a force-measuring device connected to a module for controlling the brake motor (5) of said S-type unit (4) situated before the inlet for the ribbon (R) into the furnace (3),
- at least one S-type unit (7) situated after the outlet for the strip (N) from the tunnel furnace (3) and connected to a motor,
- at least one winding spindle (8) for winding the strip (N) obtained after annealing in the form of a core made of nanocrystalline material, the amorphous ribbon (R) passing from a storage coil for the amorphous ribbon (R) fitted onto said receiving shaft (2) to the coil for the strip (N) made of nanocrystalline material successively through the S-type unit (4) situated before the inlet for the ribbon (R) into the furnace (3), then through the force-measuring device (6), then through the furnace (3) and then through the S-type unit (7) situated after the outlet for the strip (N) from the furnace (3).

The device according to the invention can additionally exhibit the following characteristics, taken alone or in combination:

- the device comprises a first winding spindle for the strip and a second winding spindle for the strip, so that it is possible, after winding a first core on the first spindle, to cut the strip (N) and to fit a head part of the strip (N) onto the second spindle, in order to carry out the winding of a second core, without interrupting the manufacturing process,
- the device comprises a single winding spindle (8) for the strip (N) and a strip storage device (9) downstream of said outlet S-type (7) of the furnace (3), making it possible to change the winding coil without interrupting the manufacturing process,
- the device additionally comprises at least one pressure roller (10) which will compress the annealed strip (N) as it passes through the S-type unit (7) situated after the outlet for the strip (N) from the tunnel furnace (3), the device additionally comprises at least one cambered roller which will compress the amorphous ribbon (R) as it passes through the S-type unit (4) situated before the inlet for said ribbon (R) into the furnace (3).

This device makes it possible to obtain a planar cross section as desired according to the invention. It should be noted that it was impossible for a person skilled in the art to predict that a nanocrystalline strip might follow the strong and alternating curves of an S-type unit with the strong superimposed tensile stresses and do this without breaking for one, indeed even several, kilometers of ribbon.

Figure 2:
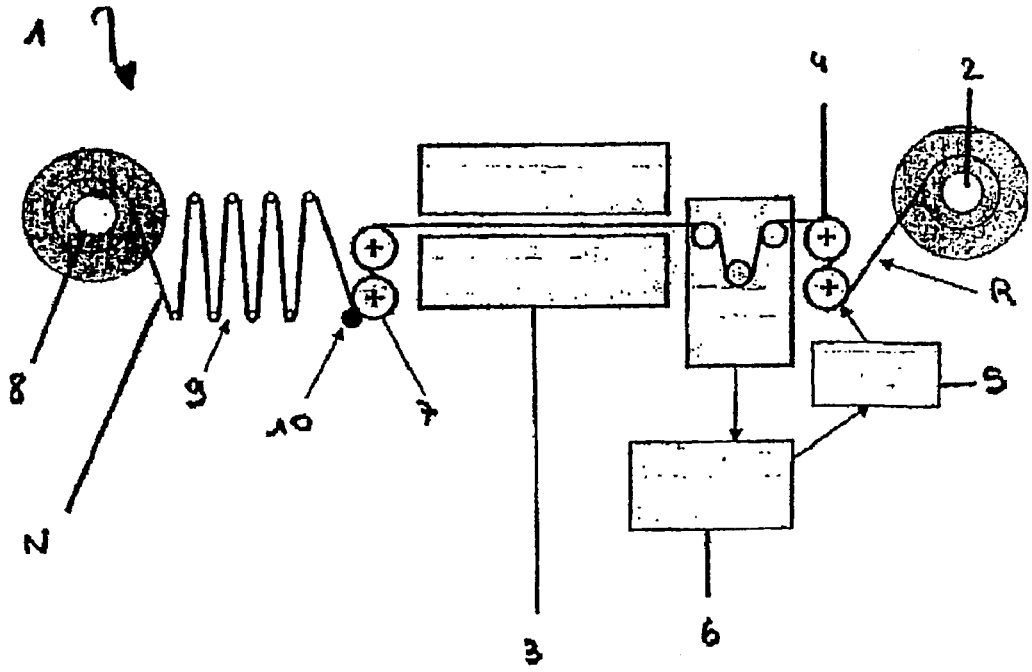

The invention will now be described with reference to the appended plates of figures, which represent:

FIG. 1: device of patent FR 2 823 507,

FIG. 2: diagrammatic view of a device according to the invention.

The alloys used for the manufacture of nanocrystalline strips according to the present invention have the following atomic composition:

$$[Fe_{1-a-b}Co_aNi_b]_{100-x-y-z-\alpha-\beta-\gamma}Cu_xSi_yB_zNb_\alpha M'_\beta M''_\gamma$$

M' being at least one of the elements V, Cr, Al and Zn, M" being at least one of the elements C, Ge, P, Ga, Sb, In and Be, with:

$a \leqq 0.07$ and $b \leqq 0.1$ $0.5 \leqq x \leqq 1.5$ and $2 \leqq \alpha \leqq 5$ $10 \leqq y \leqq 16.9$ and $5 \leqq z \leqq 8$ $\beta \leqq 2$ and $\gamma \leqq 2$ In the present patent application, unless otherwise mentioned, all the percentages relating to compositions are atomic percentages.

The use of an amorphizing element, such as boron, makes it possible to obtain, by casting with high speed cooling, an amorphous material generally in the form of a thin ribbon, which is subsequently annealed to produce a material of nanocrystalline type, that is to say a material comprising more than 50% by volume of crystals exhibiting a size of less than 100 nm in an amorphous phase constituting the balance of the volume of the material.

In the context of the present invention, the atomic percentage of boron is between 5 and 8%. This is because, if the content of boron is too low, without partial replacement by another amorphizing agent, the ribbon becomes very difficult to render amorphous by a conventional process for production by quenching on a wheel. In practice, it is not possible to have less than 5% of boron and it is preferable to have more than 6% thereof.

Conversely, on increasing the percentage of boron, the crystallization in the forward progression under stress is rendered difficult, which makes it necessary to reduce the rate R of forward progression and thus limits the available permeability range $\mu_{min} \leqq 300$) and in particular very significantly damages the coercive field Hc, which reaches values of greater than 13 A/m. Consequently, the maximum content of boron must be limited to 8%.

The elements combined under the letter M", namely C, Ge, P, Ga, Sb, In and Be, are also amorphizing elements. The partial replacement of the boron by one or more of these elements is possible for a limit level of replacement as boron is the most effective amorphizing agent with regard to the rates of quenching on a wheel necessary to obtain a 100% amorphous state before crystallization annealing under tension. This degree of replacement of the other amorphizing elements is thus limited to 2%.

The cobalt content of the strip according to the invention is at the most 5.75 at % approximately ($a \leqq 0.07$ and b, x, y, z, α, β and γ minimum). This is because, if this value is exceeded, Hc is damaged as well as the magnetic losses, which is harmful to miniaturization of the components manufactured from this strip. Due to these disadvantages, it is preferable to limit the value of a to 0.04, indeed even to 0.02 and more particularly preferably to 0.

The nickel content of the strip according to the invention is at the most 8.25 at % approximately ($b \leqq 0.1$ and a, x, y, z, α, β and γ minimum). This is because, if this value is exceeded, the saturation of the material is damaged well below 1.2 T, as well as its ability to significantly reduce the volume of the magnetic circuits compared with alternatives made of cobalt-based amorphous materials, for example. Due to these disadvantages, it is preferable to limit the value of b to 0.07, indeed even to 0.05 and more particularly preferably to 0.

In addition, it is preferable to limit the total of the contents of cobalt and nickel to approximately 8.25 at % ($a+b \leqq 0.1$).

The atomic percentage of copper in the composition according to the invention is between 0.5 and 1.5%. The percentage of copper must be kept above 0.5% as, below this value, nucleation of the nanocrystals is no longer sufficient to have crystals which are small in size and Hc increases disproportionately. On the other hand, if the percentage of copper is greater than 1.5%, many crystals are formed but this does not bring about a visible improvement in the performance while the saturated magnetization decreases.

The atomic percentage of niobium in the composition according to the invention is between 2 and 5%. This element is a growth inhibitor, the task of which is to retain a small size of crystals during the growth of the latter. Below 2% of niobium, inhibition is inadequate and Hc increases over all the types of nanocrystalline ribbons, including those produced by nanocrystallization under tension.

If the percentage of niobium is increased to 6%, the saturation induction B (20 Oe) significantly declines and in particular an embrittlement of the ribbon is observed which makes it very difficult to handle industrially without risk of frequent breakages. Consequently, the maximum percentage of niobium must be kept below or equal to 5%.

The atomic percentage of silicon in the composition according to the invention is between 10 and 16.9%. This semimetal makes it possible to adjust the magnetostriction of the nanocrystallized ribbon to a value very close to zero.

In a preferred embodiment, the silicon content of the strip according to the invention is greater than or equal to 12%. This is because, below this value, Hc declines and reaches values of the order of 8 A/m, causing relatively high, although acceptable, magnetic losses.

The elements combined under the letter M', namely V, Cr, Al and Zn, are semimetals which can replace silicon, within certain limits. This is because a replacement exceeding 2% significantly diverges from these magnetostriction values, rendering the final product sensitive to external stresses, such as winding of the ribbon over itself (stress of curvature of the strip) and packaging.

Furthermore, for use in energy storage, in smoothing of current harmonic or also common-mode self-induction coils for high frequencies, a high B-H linearity is not strictly necessary or useful or advantageous and a Br/Bm ratio (Br remanent induction, Bm induction at 20 Oe, known as "approach to saturation induction") of 10-15% may be entirely sufficient.

On the other hand, in certain cases of components, such as filtering inductors, where it is desired to attenuate in the same way, whatever the superimposed continuous component, storage inductors, where it is desired to store and transfer the same energy from and to the electrical circuit, whatever the superimposed continuous component, current sensors, where it is desired to measure and/or transform the current with the same accuracy, whatever the superimposed continuous component, a high B-H linearity is necessary. This amounts to saying, for nanocrystallized alloys under tension in forward progression, that these applications require a Br/Bm ratio of less than or equal to 3% and preferably of less than or equal to 1%. The present inventors have found, surprisingly, that the composition ranges which have just been described have to be reduced in order to achieve such values.

Thus, all the advantages of the invention already presented above and also an improved B-H linearity, such that the Br/Bm ratio is less than or equal to 3% at 20° C., are obtained by observing the following additional conditions:

$a \leqq 0.04$ and $b \leqq 0.07$ $0.5 \leqq x \leqq 1.5$ and $2 \leqq \alpha \leqq 5$ $13 \leqq y \leqq 16.6$ and $5.8 \leqq z \leqq 8$ $\beta 2$ and $\gamma \leqq 2$ In addition, in this composition range, it is observed that the Br/Bm ratio between 0 and 400° C. is less than or equal to 6% and that the $B_r/B_m$ ratio between 0 and 300° C. is less than or equal to 3%.

In addition, an optimum B-H linearity, such that the Br/Bm ratio is less than or equal to 1% at 20° C. and preferably less than or equal to 0.7% at 20° C., is obtained by observing the following additional conditions:

$a \leqq 0.02$ and $b \leqq 0.05$ $0.5 \leqq x \leqq 1.5$ and $2.5 \leqq \alpha \leqq 4$ $14.5 \leqq y \leqq 16.5$ and $5.8 \leqq z \leqq 7.5$ $\beta \leqq 1$ and $\gamma \leqq 1$ In addition, in this composition range, it is observed that the $B_r/B_m$ ratio between 0 and 400° C. is less than or equal to 1.5% and that the $B_r/B_m$ ratio between 0 and 300° C. is less than or equal to 0.8%.

The material is produced in liquid form and then cast with a high cooling rate in a plant for the chilled-roll casting of amorphous ribbons of conventional type, so that, at the outlet of the casting plant, an amorphous strip is obtained wound in the form of a coil comprising contiguous turns.

The annealing plant comprises mainly a tunnel furnace (3) which can be a resistance furnace which heats the strip by convection and radiation, a pure radiation furnace or a plant for heating the strip by the Joule effect as it passes through the furnace.

The annealing of the strip might also be carried out by a fluidized bed composed of solid or liquid particles or in one of the forms which is a sol gel and aerosol in suspension in a carrier gas, the medium for heating the strip being itself heated by contact with a chamber itself heated by a furnace of conventional type, for example a resistance furnace.

The furnace (3) comprises a central zone in which the temperature is uniform and within the range necessary to carry out the recrystallization of the strip under tension in forward progression according to the invention, this temperature being between 530° C. and 700° C. and preferably between 540° C. and 690° C. Within this range, the temperature T is varied substantially according to the rate of production R chosen and according to the tensile stress σ chosen (that is to say, also the permeability μ chosen), because to increase R or to decrease σ increases the optimum annealing temperature T. The upper temperature limit of the strip of 700° C. is imposed in order to prevent the formation of phases composed of borides, which embrittle the strip and reduce its magnetic properties.

The spindles for winding (8) and unwinding the strip are preferably under the control of motors or brakes (for example, using a powder brake on unwinder) in order to further increase the productivity of the device. The inlet S-type unit (4) and the outlet S-type unit (7) of the tunnel furnace (3) are both under the control of motors, the inlet S-type unit (4) being connected to a brake motor (5) which exhibits braking and a restraining torque on the amorphous ribbon (R) throughout the treatment. The outlet S-type unit (7) of the furnace (3) is driven by a motor, in combination with a reduction gear, and serves to drive the strip (N) in order for it to progress forward in the furnace with a perfectly regulated tensile stress and at a uniform rate which can exceed 10 cm/s. The length of the annealing furnace (3) must be suited to the rate of forward progression of the ribbon (R) so that the crystallization can be carried out correctly, it being known that the more the rate of forward progression increases, the more the length of the furnace (3) has to be increased.

The combination of these two S-type units (4, 7) makes it possible to exert a perfectly regulated tension in a perfectly uniform way over the strip width, the tensile stress in the longitudinal axial direction of the ribbon (R) in the course of treatment in the annealing furnace (3) being between 2 and 1000 MPa.

It is also possible and preferable to provide for the winding spindle (8) of the strip (N) and the unwinding spindle (2) of the amorphous ribbon (R) to be under the control of motors in order to ensure regulated tension of low amplitude (of the order of a few MPa) on the ribbon (R) before passing through the inlet S-type unit (4) and/or on the strip (N) after passing through the outlet S-type unit (7).

The tensile stress exerted on the strip (N) in forward progression during the annealing treatment is regulated using a force-measuring and force-adjusting device (6).

This device (6) can comprise a first stationary pulley and a second stationary pulley over which the strip successively passes at the inlet and at the outlet of the force-adjusting device. Between these two pulleys, the ribbon (R) passes over a pulley possessing a movable axis, the axis of which is parallel to that of the axes of the two stationary pulleys. The pulley of the movable axis is connected via a connecting rod to a force sensor attached to a support. This rod makes it possible to continuously measure the tension (F) exerted on the ribbon (R) and the corresponding measurement signal is transmitted to a module for controlling the brake motor (5) of the inlet S-type unit (4) under the control of a motor of the furnace (3).

This brake motor (5) is regulated from the force signal in order to exert, on the ribbon (R), a restraining and tensile force in the longitudinal axial direction equal to the force F which constitutes the adjusting parameter. The tensile and driving force exerted by the motor of the outlet S-type unit (7) under the control of a motor of the furnace (3) is automatically adjusted to the value of the force F imposed by the brake motor (5).

Furthermore, the device (1) according to the invention can comprise a first winding spindle for the strip and a second winding spindle for the strip, so that it is possible, after winding a first core over the first spindle, to cut the strip (N) and to fit a head part of the strip (N) onto the second spindle, in order to carry out the winding of a second core, without interrupting the manufacturing process. This changing of coils of finished products is favored in particular by the complete decoupling of the zone of high tension comprised between the two S-type units (4, 7) from the zones of weak tension before and after these units (4, 7), which decoupling makes it possible to smooth out the possible sudden fluctuations in stress. The word "core" is understood here to mean both a core wound permanently according to the size requirements of a magnetic component and a semifinished coil intended subsequently to be placed in a manual or automatic core winder (comprising the operations of unwinding, measuring the length of the strip, winding the core, cutting to length, adhesive bonding of the external turn and removal from the spindle).

It is also possible to add at least one pressure roller (10) to the outlet of the S-type unit (7) which will compress the annealed strip (N) as it passes through the S-type unit (7) situated after the outlet for the strip (N) from the tunnel furnace (3). This additional roller (10) of the S-type unit can be cambered. It is preferable and advantageous to position cambered rollers in the S-type units (4, 7) as not only will they thus compress the amorphous ribbon (R) or the nanocrystalline strip (N) as it passes through the S-type unit (4, 7) but they additionally make it possible to automatically center the ribbon (R) or the strip (N), making possible a forward progression which does not deviate from its path, and can be subjected to an even tensile stress uniformly distributed over its width and over the whole of the contact surface area of the rollers of the S-type units (4, 7).

It is also possible to increase the adhesion of the strip, its stability and its centering along the transverse axis of the rolls by inserting other S-type units in line on the process. This can make it possible in addition to regulate the ratio of stresses between the zone of high tension (between S-type units) and the upstream and downstream zones of reduced tension, and also the distribution of the localized stresses, and thus to further ultimately reduce the level of breakage per km.

The process according to the invention can also make it possible to produce wound cores at high speed of round or oblong shape at a later time on a winding location disconnected from the production location for annealing under tension. In this case, the winding is carried out from coils of strips produced by annealing under tension according to the invention. For the manufacture of oblong cores, nonmagnetic winding supports have to be added at the time of the winding of the strip resulting from the process for annealing under tension and can subsequently be removed after the coating or the impregnation of the core, or else be retained.

Furthermore, it can be advantageous to use a magnetic spindle or a spindle with suction in order to immobilize the ribbon start on the spindle.

Generally, the conditions for the crystallization of the strip inside the annealing furnace (3) under tension are such that the strip comprises at least 50% by volume of nanocrystals having a size of between 2 and 20 nm. The various crystals are separated from one another by the matrix composed of the fraction of the alloy which has remained amorphous.

One of the advantages of the process according to the invention is that of being able to employ a very broad range of tensile stresses ranging from 2 to 1000 MPa. This makes it possible to achieve permeabilities of between 50 and 5000.

In particular, by using a tensile stress of greater than 250 MPa and better still of greater than 500 MPa, it is possible to manufacture a nanocrystalline strip exhibiting a permeability of between 50 and 200, which range was hitherto impossible to achieve by conventional processes (for example, FR 2 823 507). Thus, it was possible to obtain a permeability of the order of 90 for a stress of 400 MPa and a permeability of 50 for a stress of 700 MPa.

Furthermore, by subjecting the amorphous ribbon to high tensile stresses, it is possible to reduce the thickness of the nanocrystalline strip by 3 to 10%, indeed even more. Thus, a ribbon with a thickness of 20 μm can be converted to a strip with a thickness of 18 or 19 μm. This reduction in thickness of the nanocrystalline strip has consequences with regard to the magnetic performance of the components manufactured from the strip. This is because this reduction in thickness makes it possible to reduce the currents induced in the metal and thus the magnetic losses of the future wound core.

In addition, the present inventors have found that this better magnetic performance is obtained without damaging the dilatation of the strip, which is entirely surprising as it is known that the more the thickness of a wound metal sheet decreases, the more the dilatation of the winding increases.

In order to reduce the currents induced in the core and the magnetic losses, it may be necessary, depending on the final applications intended for the core, to deposit or to form an electrical insulation layer on the strip in order to isolate the successive turns from one another. It is possible, for example, to continuously deposit on the strip, after annealing, a mineral substance over a thickness from a tenth of a micrometer to several micrometers.

Such a mineral substance deposited between the turns can be composed of a milk of magnesia (MgO), the water of which is removed in a subsequent low-temperature stoving operation.

More generally, use may be made of the following conventional compositions:

- $SiO_2$, MgO, $Al_2O_3$ powder deposited at the surface by immersion in a resin, by spraying, by electrophoresis or by any other deposition technique,
- deposition of fine layers of $SiO_2$, MgO, $Al_2O_3$ at the surface by CVD or PVD spraying or an electrostatic method,
- solution of alkyl silicate in alcohol, mixed with an acid, to form forsterite $MgSiO_4$ after heat treatment,
- solution obtained by partial hydrolysis of $SiO_2$ and of $TiO_2$ mixed with various ceramic powders,
- solution comprising mainly a polytitanium carbonate applied to the ribbon and then heated,
- phosphate solution applied and heated,
- insulation solution formed by application of an oxidizing agent and heating.

Preferably, the insulation layer is deposited either on the strip unwound from the coil obtained on conclusion of the annealing, before rewinding in the form of one or more cores for an electromagnetic component, or in line at the outlet of the motor S-type unit before winding as a coil. In both cases, this deposition is generally followed by a low-temperature annealing in order to provide polymerization or dehydration.

It is also possible to use a coating, prior to the crystallization annealing, having insulating properties, which coating is deposited on the amorphous ribbon over a thickness from 1/10 of a micrometer to a few tens of micrometers and is resistant to the temperatures of the flash annealing and to the high tensions of the annealing. It is possible, for example, to use magnesium methoxide as precoating of the amorphous strip.

This type of coating for insulation prior to the annealing or for electrical insulation of the annealed strip can be produced by any appropriate means and in particular by coating between two rolls, or by deposition of CVD or PVD type, or by spraying, or by fluidized bed, and the like, with an optional additional stage of drying and/or polymerization and/or of crosslinking, depending on the nature of the insulating material, on the type of monomer and on the presence of solvent, inter alia.

When use is made of a mineral insulating coating (temperature-resistant), the coating is preferably carried out on the amorphous ribbon before the nanocrystallization annealing and particularly preferably before the inlet S-type unit. The present inventors have found that a portion of the insulating material becomes detached from the amorphous ribbon as it passes through the annealing furnace but in particular that the residual insulating material makes it possible to reinforce the mechanical characteristics of the ribbon while reducing its brittleness.

In addition, the tension necessary to obtain a predefined level of permeability is then found to be reduced. It is thus possible to achieve even lower permeabilities by increasing the tension.

It is also possible, in a way entirely different from and complementary to interturn insulation, to coat the cores according to the invention (wound beforehand as a core according to the geometric requirements dictated by the application) with a plastic, such as an epoxy resin, for example, it being possible for this resin to be applied under hot or cold conditions. It has been found that a coating of this type did not in any way damage the magnetic performance of the cores, even when the resin is applied at a temperature of the order of 200° C. This coating does not significantly penetrate between the turns and has the role of stiffening and protecting the core from winding stresses, of protecting the electrical insulating material of the winding wire from injuries by the cutting edges of the wound strip and of providing good dielectric insulation between wound core and the windings.

In addition to the interturn electrical insulation coatings or the external coating of the core for electrical and mechanical protection of the core and of its winding which have just been described, it is also possible to impregnate the existing intervals between the turns of a core according to the invention using a specific fluid and hardening resin without substantial damage to its permeability. In this state, the core becomes very rigid and monoblock and thus capable of being cut.

The impregnated core thus produced can then be cut into 2 Cs with an increase in the coercive field $H_c$ not exceeding 50%, while the permeability $\mu_1$ of the magnetic circuit produced with the joined 2 Cs can be adjusted by appropriate surface treatment of the cut surfaces to a level lower by at most 50% with respect to $\mu$.

If, for example, an impregnated core according to the invention is produced, the permeability of which amounts to $\mu$=300, it would be possible to obtain a permeability $\mu_1$ of between 150 and 300. This reduction is due to the residual air gap resulting from the cutting.

It is thus seen that it is possible to make available a core of low permeability having all the performance characteristics of the stress annealed nanocrystalline materials which have been described above and also a 2 C geometry which makes it possible to obtain a compact final component which does not exhibit an air gap, other than a residual air gap, which might disrupt external magnetic fields and cause localized temperature rises around the air gap zones.

Tests

A series of castings 1 to 19, the compositions of which are collated in table 1, were produced in order to obtain amorphous ribbons according to the conventional process of quenching on a cooled wheel.

These ribbons were subsequently subjected to various annealing processes, the characteristics of which processes are collated in table 2.

Once converted into nanocrystalline strips by stress annealing, the latter were subjected to a certain number of characterization tests, the results of which are themselves also collated in table 2.

In the context of these tests, the following terms are used:

RP: the process for the stress annealing of nanocrystalline materials which is already known, using one or two pairs at least of pinch rolls (cf. patent FR 2 823 507).

Direct: the process for the stress annealing of nanocrystalline materials which is already known, using direct tension on the ribbon through the winding and unwinding coils (cf. patent FR 2 823 507).

BS: the process for the stress annealing of nanocrystalline materials as described in this invention using, for example, an S-type unit at the inlet of the annealing furnace and an S-type unit at the outlet of this furnace.

The following symbols are also used:

$D_{MIN}$ radius of curvature at the limit of failure of the strip, $T_{TTH}$ nanocrystallization annealing temperature, $\sigma$ tensile stress during the annealing, $\mu r$ relative permeability, $\Delta T$ range of the values of the annealing temperature making it possible to obtain $D_{MIN} \leqq 3$ mm for the entire available $\mu r$ range, Br remanent induction, Bm induction at 20 Oe, "approach to saturation induction", B(200) saturation induction at 200 Oe, Hc coercive field.

The term "$\mu r$ range" is understood to mean the extent of available $\mu r$ values at a given casting for given process characteristics, within the maximum $\mu r$ range from 50 to 5000.

Determination of $D_{MIN}$

The radius of curvature at the limit of failure of the strip $D_{MIN}$ is measured by placing the strip on a series of hemispherical graded forms, the diameter of which decreases, until the strip breaks. Diameters from 5 to 2.5 mm are successively used and in decreasing values in steps of 0.1 mm.

Determination of $\Delta T$ $\Delta T$ is the range of the values of the annealing temperature making it possible to obtain $D_{MIN} \leqq 3$ mm for the entire available $\mu r$ range. This is because it is considered that the brittleness of the strip is compatible with a process on the industrial scale when $D_{MIN}$ is less than 3 mm.

In order to determine the value of $\Delta T$, $D_{MIN}$ is thus measured for strips of various permeabilities obtained by varying the tensile stress during the annealing, this being done for different values of the annealing temperature $T_{TTH}$.

Thus, for a casting of composition No. 1 (cf. table 1), the following values were obtained for $D_{MIN}$:

| | Permeability $\mu r$ | | | | |
|---|---|---|---|---|---|
| $T_{TTH}$ (° C.) | 200 | 300 | 600 | 1000 | 1700 |
| 570 | 1.9 | * | 1.9 | 2.0 | 2.3 |
| 590 | 1.7 | * | 2.2 | 2.7 | 2.7 |
| 600 | 2.5 | 2.7 | 3.1 | 3.5 | 3.6 |

* tests not carried out.

In this example, the value of $\Delta T$ is estimated at 30° C. between 560 and 595° C.

It is found that the more the permeability increases, the more $D_{MIN}$ increases, to stabilize at $\mu$=1500-2000. The least brittle ribbon is thus that which has the lowest permeability, which is an additional advantage in miniaturization for applications of energy smoothing/storage type.

It is also noted that $D_{MIN}$ is very sensitive to the temperature for annealing under tension. Thus, a difference of 30° C. causes all the strips having a permeability of greater than 500 to change from a state of slight brittleness obtained at 570° C. ($D_{MIN} \leqq 3$ mm) to an increasingly brittle state (it being possible for $D_{MIN}$ to reach 3.6 mm).

TABLE 1

| Casting | % Co | % Ni | % Cu | % Si | % B | % Nb | % M' | % M'' |
|---|---|---|---|---|---|---|---|---|
| 1 | 0 | 0 | 1.0 | 15.3 | 6.5 | 2.96 | | |
| 2 | 1.7 | 0 | 1.0 | 15.3 | 6.5 | 2.96 | | |
| 3 | 5.0 | 0 | 1.0 | 15.3 | 6.5 | 2.96 | | |
| 4 | 5.0 | 0 | 1.0 | 15.3 | 6.5 | 2.96 | | |
| 5 | 10 | 0 | 1.0 | 15.3 | 6.5 | 2.96 | | |
| 6 | 0 | 0 | 1.5 | 15.5 | 7 | 3.02 | | |
| 7 | 0 | 0 | 0.7 | 15.2 | 6.8 | 2.98 | | |
| 8 | 0 | 0 | 1.02 | 15.1 | 6.6 | 3.9 | | |
| 9 | 0 | 0 | 0.97 | 15.4 | 6.7 | 6 | | |
| 10 | 0 | 0 | 0.99 | 14.4 | 6.4 | 2.97 | Cr: 0.98 | |
| 11 | 0 | 0 | 1.03 | 14.1 | 6.3 | 2.88 | Al: 1.53 | |
| 12 | 0 | 0 | 1.1 | 15.3 | 5.3 | 2.95 | | C: 1.22 |
| 13 | 0 | 0 | 1.01 | 13.1 | 6.2 | 2.99 | V: 2.4 | |
| 14 | 0 | 0 | 1.02 | 12.6 | 6.3 | 2.98 | | Ge: 2.6 |
| 15 | 0 | 0 | 1.02 | 13.5 | 6.5 | 2.98 | | |
| 16 | 0 | 0 | 0.99 | 11.5 | 6.6 | 3.01 | | |
| 17 | 0 | 0 | 0.98 | 15.2 | 8.4 | 2.96 | | |
| 18 | 2.0 | 1.0 | 1.0 | 15.3 | 6.5 | 2.96 | | |
| 19 | 2.2 | 3.0 | 1.0 | 15.3 | 6.5 | 2.96 | | |

However, with this high percentage of boron, the crystallization in forward progression under stress is made difficult and in particular slower than all the tests which can be operated industrially, such as C, D, E and F, for example, which makes it necessary to reduce the rate of forward progression to less than 4 cm/sec and which limits the available permeability range to permeabilities of greater than 300. Consequently, the maximum boron content has to be limited to 8%.

Furthermore, example N shows that 1.22% of carbon as partial replacement for boron causes very little damage to the performance of the product.

Influence of the Niobium Content

Example J shows that, if a percentage of niobium of the order of 3.9% is used, the magnetic performance is retained overall with, however, a fall in the saturation induction B(200 Oe) to 12 kG, instead of 12.5 kG for a composition such as that used for examples A to C, which comprises only 2.96% of niobium.

Furthermore, the rate of forward progression has to be considerably lowered in order to make it possible to obtain a stress annealed ribbon with the required performance of limit curvature ($\leqq 3$ mm) and of available permeability range.

If the percentage of niobium is increased to 6% (example K), the temperature adjusting range increases further (50° C.) and the available permeability range still remains attractive ($\mu_{min}=200$). However, the saturation induction B(200 Oe) declines significantly to 11.2 KG, which does not make it possible to manufacture components as compact as would be desired.

In addition, the limit diameter for the winding in core form starting from the strip nanocrystallized under stress increases markedly to 3.8 mm, which testifies to an embrittlement of the strip which renders it very difficult to handle industrially without risk of frequent breakages.

TABLE 2

| | | Process parameters | | | | | | Results | | | | | |
|---|---|---|---|---|---|---|---|---|---|---|---|---|---|
| Test | Casting No. | Process type | $D_{MIN}$ (mm) | $T_{TTH}$ (° C.) | Rate (cm/s) | σ range (MPa) | ΔT range of $T_{TTH}$ (° C.) | Number of breakages per km | Br/Bm (%) | Range of μr | Hc (A/m) | B(200) (kG) | Test confirming the invention |
| A | 1 | RP | ≦2.5 | 660 | 3 | ≦500 | 30 | >50 | <1 | ≧200 | 2 to 5 | ≧12 | |
| B | 1 | direct | ~3 | 655 | 1 | ≦300 | 30 | >10 | <1 | ≧300 | 2 to 5 | ≧12 | |
| C | 1 | BS | ≦2.5 | 590 | ≧10 | ≦1000 | 30 | <5 | <1 | ≧50 | 3 | ≧12 | X |
| D | 2 | direct | 3 | 665 | 1 | ≦300 | 30 | >10 | 1 | ≧350 | 6 | ≧12 | |
| D' | 2 | BS | ≦2.5 | 595 | ≧10 | ≦1000 | 30 | <5 | <3 | ≧300 | 4 | ≧12 | X |
| E | 3 | direct | 3 | 665 | 1 | ≦300 | 30 | >10 | 2 | ≧500 | 7 | 12 | |
| E' | 3 | BS | 2.7 | 625 | ≧10 | ≦1000 | 30 | <5 | <3 | ≧600 | 6 | 12 | X |
| F | 4 | BS | 2.5 | 610 | ≧10 | ≦500 | 30 | <5 | 2 | ≧280 | 6.5 | 12 | X |
| G | 5 | BS | 3 | 670 | 1 | ≦300 | 30 | 20 | 4-5 | ≧500 | 10 | 11.5 | |
| H | 6 | BS | ≦2.5 | 580 | ≧10 | ≦1000 | 30 | <5 | <1 | ≧50 | 1 to 5 | ≧12 | X |
| I | 7 | BS | 2.5 | 605 | ≧10 | ≦1000 | 30 | <5 | <1 | ≧50 | 2 to 6 | ≧12 | X |
| J | 8 | BS | 2.7 | 630 | 5 | ≦1000 | 40 | <5 | <1 | ≧70 | 2 to 5 | 12 | X |
| K | 9 | BS | 3.8 | 700 | 0.5 | ≦300 | 50 | <5 | 1.7 | ≧200 | 8 | 11.2 | |
| L | 10 | BS | 2.6 | 590 | ≧10 | ≦1000 | 20 | <5 | 1.3 | ≧80 | 2 to 6 | ≧12 | X |
| M | 11 | BS | ≦2.5 | 590 | ≧10 | ≦500 | 20 | <5 | 1.8 | ≧150 | 2 to 7 | ≧12 | X |
| N | 12 | BS | 2.8 | 610 | 10 | ≦1000 | 13 | <5 | <1 | ≧70 | 2 to 6 | ≧12 | X |
| O | 13 | BS | 3.4 | 620 | 3 | ≦1000 | <10 | >10 | 3.0 | ≧300 | 4 to 9 | ≧12 | |
| P | 14 | BS | 2.7 | 600 | ≧10 | ≦1000 | <10 | <5 | 2.7 | ≧100 | 8 to 12 | ≧12 | |
| R | 15 | BS | ≦2.5 | 615 | 3.3 | 50 | 30 | <5 | 5 | ≧100 | 5.6 | ≧12 | X |
| S | 15 | BS | ≦2.5 | 640 | 3.3 | 50 | 30 | <5 | 3 | ≧100 | 7 | ≧12 | X |
| T | 15 | BS | ≦2.5 | 650 | 3.3 | 50 | 30 | <5 | 17 | ≧100 | 91 | ≧12 | |
| U | 16 | BS | ≦2.5 | 620 | 3.3 | 50 | 20 | <5 | 8 | ≧300 | 8 | ≧12 | X |
| V | 17 | BS | ≦2.5 | 550 | 1.6 | 50 | 0 | <5 | 15.3 | ≧300 | 13.6 | 11.8 | |
| W | 17 | BS | ≦2.5 | 550 | 2.4 | 50 | 0 | <5 | 2.6 | ≧300 | 14 | 11.8 | |
| X | 17 | BS | ≦2.5 | 550 | 3.2 | 50 | 0 | <5 | 9 | ≧300 | 26.4 | 11.8 | |
| Y | 18 | BS | ≦2.5 | 600 | 2.6 | ≦1000 | 30 | <5 | <2 | ≧350 | 4.5 | >12 | X |
| Z | 19 | BS | ≦2.5 | 610 | 2.6 | ≦1000 | 30 | <5 | <3 | ≧400 | 4.8 | >12 | X |

EXAMPLE 1

Influence of the Composition of the Grade

Influence of the Boron Content

Examples V, W and X, the boron content of which is 8.4%, exhibit a brittleness of a correct level, with a level of breakage of less than 5 breakages/km.

Influence of the Copper Content

Examples H and I show that to diverge somewhat from a copper content of 1%, to respectively reach 1.5 or 0.7%, does not significantly damage the performance.

Influence of the Silicon Content

With respect to the ribbons of examples A to C, which comprise 15.3% of silicon, it is found (tests R to U) that, if the percentage of silicon is lowered to 13.5%, the metal remains suitable for industrial production (<5 breakages/km) and the available permeability range remains huge ($\mu_{min}$=100) but the conditions of the BS process according to the invention become more critical with regard to the magnetic characteristics, such as the coercive field Hc.

Thus, for annealing temperatures of 615 and 640° C., Hc remains less than or equal to 7 A/m but, from 650° C., Hc increases very significantly (example T), which does not preclude industrial production since the stress annealing temperature adjusting range ΔT remains high (~30° C.). However, if the percentage of silicon is lowered further until it reaches 11.5 (example U), the coercive field declines to reach 8 A/m when optimum conditions of brittleness are present, resulting in excessively high magnetic losses for the wound core.

Influence of the Content of Element of Type M'

It is necessary to limit the possible content of these replacement semimetals for silicon to at most 2%. This is because examples L and M show that contents of chromium of 1% or of aluminum of 1.5% are not harmful to the advantage of the final product when they are replacements for silicon.

On the other hand, example O shows that a vanadium content of 2.4% markedly increases the brittleness of the ribbon (>10 breakages/km), which leads to a reduction in the allowable rate of forward progression due to this increased brittleness. At the same time, the coercive field Hc declines and the temperature range ΔT of the process over which correct performances can be obtained becomes excessively small (<10° C.), rendering the strip unsuitable for industrial manufacture. Furthermore, the available μr range is reduced to μr≧300.

Influence of the Content of Element of Type M"

Example P shows that, when silicon is replaced by 2.6% of germanium, the coercive field Hc considerably declines (≧8 A/m) and the annealing temperature range ΔT available is small, whereas the other characteristics remain entirely advantageous.

Influence of the Cobalt Content

Examples D and E show that the moderate addition of cobalt as partial replacement for iron, at a level of 1.7% and 5%, damages the available permeability μ range by the "direct" process, since $\mu_{min}$ changes from 300 to 350 and from 300 to 500, respectively.

In the case of the BS process according to the invention, the allowable cobalt content appears to be 0.05 (example F: $\mu_{min}$=300) whereas, with 10% cobalt, it is not possible to access, by the process, a permeability of less than 500 (example G).

Additional tests with regard to examples C, D', E', Y and Z made it possible to determine the values of their magnetic losses at 500 kHz (50 mT, 27° C.) and to determine the temperature stability of their permeability values between 25 and 150° C. and their apparent saturation magnetostrictions λs.

| Test | % Co | % Ni | % Co + % Ni | μ(150° C.)/ μ(25° C.) | Magnetic losses (in mW/cm$^3$) | μr range | Hc (A/m) | λs (ppm) |
|---|---|---|---|---|---|---|---|---|
| C | 0 | 0 | 0 | 1.2 | 230 | ≧50 | 3 | 0.5 |
| D' | 1.7 | 0 | 1.7 | 1.4 | 480 | ≧300 | 4 | 0.8 |
| E' | 5.0 | 0 | 5.0 | 1.5 | 1225 | ≧600 | 6 | 1.3 |
| Y | 2.0 | 1.0 | 3.0 | 1.45 | 610 | ≧350 | 4.5 | 1 |
| Z | 2.2 | 3.0 | 5.2 | 1.6 | 780 | ≧400 | 4.8 | 1.5 |

It is found that, for tests according to the BS process, the increase in the cobalt content additionally damages the coercive field Hc and also the level of magnetic losses. These two points do not make it possible to obtain an alloy which is highly sensitive to weak signals in measuring devices or which is weakly dissipating. Consequently, cobalt is limited to at most 5.75 at % approximately (a≦0.07).

Furthermore, the increase in the cumulative contents of cobalt and nickel is damaging to the apparent saturation magnetostriction λs, which renders the alloy sensitive to external stresses (adhesive bonding, coating, impregnation, cutting, handling). This increase is also damaging to the temperature stability of the permeability between 25 and 150° C. Consequently, nickel is limited to at most 8.25 at % approximately (b≦0.1) and, preferably, cumulative contents of Ni and Co are limited to at most 8.25 at % (a+b≦0.1).

EXAMPLE 2

Dilatation

In order to study the influence of the stress applied (to the ribbon) on the dilatation of the nanocrystalline core, a series of amorphous ribbons was prepared, the compositions of which are in accordance with casting 1 in table 1, and the amorphous ribbons were subjected to increasing tensile stresses. The conditions of the tests and the results obtained in terms of reduction in thickness (ΔEp/Ep) and of dilatation are collated in table 3:

TABLE 3

| Stress (MPa) | Thickness (μm) | ΔEp/Ep | Dilatation (%) |
|---|---|---|---|
| 0 | 17.9 | | 87.1% |
| 19.9 | 17.8 | −0.6% | 86.7% |
| 39.8 | 17.7 | −1.2% | 87.7% |
| 79.5 | 17.4 | −2.8% | 87% |
| 119 | 17.2 | −4.1% | 86.2% |
| 171 | 16.8 | −6.4% | 84.6% |
| 200 | 16.6 | −8.4% | 85.3% |
| 300 | 16.1 | −11% | 85.7% |
| 500 | 14.9 | −16.8% | 84.5% |

It is found that the process according to the invention makes it possible to reduce the thickness of the nanocrystalline strip without significantly damaging the dilatation, which was in no way foreseeable.

Mention may be made, from the viewpoint of the possible applications of the nanocrystalline strips according to the invention, by way of indication and without implied limitation, of:

- current sensors with a strong superimposed continuous component, in particular used in some models of energy meters;
- broad frequency band current probes, with or without shielding, with use, for example, in the real time current control of active components of power electronics, such as GTO, IGBT, and the like;
- energy storage or smoothing inductors for any type of power electronics converter structure, such as PFC, push pull, flyback, forward, and the like, which make it possible:
  - to reduce the volume of the component by virtue of access to low permeabilities, with reduced magnetic losses and a high saturated magnetization $J_s$ under strong superimposed continuous current stresses;
  - to provide an inductance L which is not very greatly dependent on the superimposed continuous current and which is highly reproducible (≦10%, preferably ≦5%) in industrial production;
  - to prevent any acoustic noise due to the magnetostriction;
  - to prevent any problem related to electromagnetic compatibility;
  - a to prevent any localized temperature rise of the magnetic circuit;
- HF transformers (greater than several hundred kHz) comprising uncut cores according to the invention for use in resonance power supplies, for example. The core according to the invention is here advantageous for its high cutoff frequency, which can reach from 20 to 200 MHz for permeabilities from 50 to 300, with low magnetic losses and a high available working induction ($J_s$>1 T);
- common-mode self-induction coils with HF filtering comprising uncut cores according to the invention, which exhibit the advantage of being able to miniaturize the component by virtue of both a high $J_s$ and a high cutoff frequency ranging from 1 to 200 MHz and preferably greater than 10 MHz.

What is claimed is:

1. A process for the manufacture of a strip made of nanocrystalline material which is obtained from a ribbon cast in an amorphous state, said strip having the atomic composition:

$$[Fe_{1-a-b}Co_aNi_b]_{100-x-y-z-\alpha-\beta-\gamma}Cu_xSi_yB_zNb_\alpha M'_\beta M''_\gamma$$

wherein M' is at least one of the elements V, Cr, Al and Zn, and M" is at least one of the elements C, Ge, P, Ga, Sb, In and Be, with:

$a \leqq 0.07$ and $b \leqq 0.1$ $0.5 \leqq x \leqq 1.5$ and $2 \leqq \alpha \leqq 5$ $10 \leqq y \leqq 16.9$ and $5 \leqq z \leqq 8$ $\beta \leqq 2$ and $\gamma \leqq 2$ by subjecting the amorphous ribbon to a crystallization annealing in which the ribbon is subjected to the annealing in the unwound state, in forward progression through at least two S-type units and under tension in a substantially longitudinal axial direction of the ribbon, so that the ribbon is maintained at an annealing temperature of between 530° C. and 700° C., for a period of time of between 5 and 120 seconds, under an axial tensile stress of between 2 and 1000 MPa, the tensile stress to which said amorphous ribbon is subjected, its rate of forward progression during said annealing, the annealing time and the annealing temperature being chosen so that the cross section profile of the strip is not Ω-shaped and exhibits a maximum deflection of the transverse cross section of the strip of less than 3% of the width of the strip.

2. The process as claimed in claim 1, in which the rate of forward progression of the strip is greater than or equal to 10 cm per second and per meter of furnace working zone.

3. The process as claimed in claim 1, in which the axial tensile stress is greater than 500 Mpa and up to 1000 Mpa.

4. The process as claimed in claim 1, in which the level of breakage of the amorphous ribbon in forward progression is less than 10 breakages per kilometer of ribbon.

5. The process as claimed in claim 1, in which, in addition, y is greater than or equal to 12 and less than or equal to 16.9.

6. The process as claimed in claim 1, in which:

$a \leqq 0.04$ and $b \leqq 0.07$ $0.5 \leqq x \leqq 1.5$ and $2 \leqq \alpha \leqq 5$ $13 \leqq y \leqq 16.6$ and $5.8 \leqq z \leqq 8$ $\beta \leqq 2$ and $\gamma \leqq 2$.

7. The process as claimed in claim 6, in which:

$a \leqq 0.02$ and $b \leqq 0.05$ $0.5 \leqq x \leqq 1.5$ and $2.5 \leqq \alpha \leqq 4$ $\beta \leqq 1$ and $5.8 \leqq z \leqq 7.5$.

8. The process as claimed in claim 1, in which:

$a+b \leqq 0.1$.

9. The process as claimed in claim 1 in which:

$a=0$.

10. The process as claimed in claim 1, in which:

$b=0$.

11. The process as claimed in claim 1, wherein the maximum deflection of the transverse cross section of the strip is less than 1% of the width of the strip.

12. The process as claimed in claim 1, wherein the strip has a planar cross section.

* * * * *